US008864869B2

(12) United States Patent
Kurisu et al.

(10) Patent No.: US 8,864,869 B2
(45) Date of Patent: Oct. 21, 2014

(54) HEARTH ROLL IN A CONTINUOUS ANNEALING FURNACE AND ITS PRODUCTION METHOD

(75) Inventors: Yasushi Kurisu, Tokyo (JP); Tatsuo Suidzu, Funabashi (JP)

(73) Assignees: Nippon Steel & Sumitomo Metal Corporation, Tokyo (JP); Tocalo Co., Ltd., Hyogo (JP)

( * ) Notice: Subject to any disclaimer, the term of this patent is extended or adjusted under 35 U.S.C. 154(b) by 806 days.

(21) Appl. No.: 12/734,680

(22) PCT Filed: Nov. 28, 2008

(86) PCT No.: PCT/JP2008/072106
§ 371 (c)(1),
(2), (4) Date: May 13, 2010

(87) PCT Pub. No.: WO2009/069829
PCT Pub. Date: Jun. 4, 2009

(65) Prior Publication Data

US 2010/0230874 A1 Sep. 16, 2010

(30) Foreign Application Priority Data

Nov. 28, 2007 (JP) ..... 2007-307100

(51) Int. Cl.

| | |
|---|---|
| ***C22C 19/05*** | (2006.01) |
| ***C23C 4/06*** | (2006.01) |
| ***C22C 19/07*** | (2006.01) |
| ***C21D 9/56*** | (2006.01) |
| ***C23C 4/18*** | (2006.01) |
| ***C22C 29/02*** | (2006.01) |
| ***F27B 9/24*** | (2006.01) |

(52) U.S. Cl.
CPC . *C23C 4/06* (2013.01); *C22C 19/07* (2013.01); *C21D 9/563* (2013.01); *C23C 4/18* (2013.01); *C22C 29/02* (2013.01); *C22C 19/05* (2013.01); *F27B 9/2407* (2013.01); *F27B 9/2469* (2013.01)
USPC ..... 75/234; 75/237; 75/240; 75/246; 266/249; 427/450

(58) Field of Classification Search
CPC ..... C21D 9/563; F27B 9/2407
USPC ..... 75/249, 234
See application file for complete search history.

(56) References Cited

U.S. PATENT DOCUMENTS 5,070,587 A * 12/1991 Nakahira et al. ..... 432/246

FOREIGN PATENT DOCUMENTS

| | | |
|---|---|---|
| JP | 1-176064 | 7/1989 |
| JP | 3-75383 | 3/1991 |

(Continued)

OTHER PUBLICATIONS

International Search Report dated Mar. 10, 2009 issued in corresponding PCT Application No. PCT/JP2008/072106.

*Primary Examiner* — Jessee Roe
*Assistant Examiner* — Christopher Kessler
(74) *Attorney, Agent, or Firm* — Kenyon & Kenyon LLP

(57) ABSTRACT

The hearth roll for a continuous annealing furnace is able to suppress the occurrence of buildup on the hearth roll surface and able to be stably used for a long period under the high temperature environment. The hearth roll has a cermet coating comprised 50 to 90 vol % of ceramic and the balance of a heat resistant alloy on its surface, the ceramic containing $Cr_3C_2$: over 50 to 90 vol %, $Al_2O_3$: 1 to 40 vol %, $Y_2O_3$: 0 to 3 vol %, and $ZrB_2$: 0 to 40 vol % and having a balance of unavoidable impurities and pores, the heat resistant alloy containing Cr: 5 to 20 mass %, Al: 5 to 20 mass %, and one or both of Y and Si: 0.1 to 6 mass % and has a balance of one or both of Co and Ni and unavoidable impurities.

3 Claims, 1 Drawing Sheet

(56) References Cited

FOREIGN PATENT DOCUMENTS

| | | |
|---|---|---|
| JP | 3-86306 | 4/1991 |
| JP | 3-272959 | 12/1991 |
| JP | 6-116703 | 4/1994 |
| JP | 7-11420 | 1/1995 |
| JP | 9-78219 | 3/1997 |
| JP | 2005-105338 | 4/2005 |
| WO | WO 01/34866 | 5/2001 |

* cited by examiner

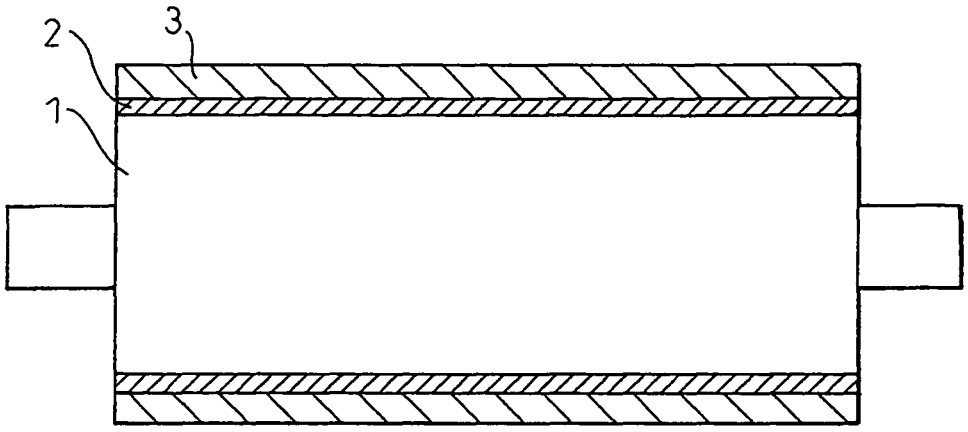
2
3
1

HEARTH ROLL IN A CONTINUOUS ANNEALING FURNACE AND ITS PRODUCTION METHOD

This application is a national stage application of International Application No. PCT/JP2008/072106, filed 28 Nov. 2008, which claims priority to Japanese Application No. 2007-307100, filed 28 Nov. 2007, which is incorporated by reference in its entirety.

TECHNICAL FIELD

The present invention relates to a hearth roll for a continuous annealing furnace provided with a flame sprayed coating on its surface and suppressing buildup on a roll surface at the time of rolling and to a method of production of the same.

BACKGROUND ART

In facilities for production of metal sheet materials, in particular steel-sheet-making process lines, when making a conveying roll rotate at a high speed to feed steel sheet, the phenomena of slipping and snake motion of the steel sheet, deposition and buildup of dirt on the surface of the conveying roll etc. occur.

In particular, in a continuous annealing furnace, the hearth rolls convey steel sheet in a high temperature state, so buildup easily occurs on the hearth roll surfaces. When such buildup occurs, the shapes of the buildup are transferred to the steel sheet surface whereby the surface quality is impaired and the grade of the steel sheet deteriorates. Not only this, at the time of periodic repair, it is necessary to clean the hearth rolls to remove foreign matter deposited on their surfaces, so this becomes one cause of a drop in productivity.

The buildup on the hearth roll surfaces is the phenomenon of the iron, manganese oxide, etc. on the steel sheet surface sticking to and building up on the hearth roll surfaces. To prevent this, it is effective to suppress the reaction of the sources of buildup, that is, iron, manganese oxide, etc. with the hearth roll surfaces or facilitate removal of reaction products.

As a measure for suppressing buildup on a hearth roll surface, a coating obtained by providing a flame sprayed alloy layer comprised of only a heat resistant alloy on a hearth roll, flame spraying particles of a carbide or a mixture of a carbide and oxide on the sprayed alloy layer, and depositing metal oxides comprised of $Cr_2O_3$ and $Al_2O_3$ on the outermost layer of the surface to give a chemically converted layer has been proposed (for example, see Japanese Patent Publication (B2) No. 8-19535).

However, the $Cr_2O_3$ and $Al_2O_3$ provided at the outermost layer of the surface easily react with manganese oxide, so the coating has the problem of easy generation of buildup due to manganese oxide.

Further, a coating containing, by wt %, chrome carbides: 10 to 25% and Ni: 5 to 15% and having a balance of one or more of a carbide and boride of tungsten and unavoidable impurities has been proposed (for example, see Japanese Patent Publication (A) No. 3-86306).

However, with this coating, WC oxidizes at a high temperature and the coating peels off, so there is the problem that use for a long time in an annealing furnace is not possible.

Furthermore, a coating comprising a cermet material of a particle structure comprised of, by wt %, 50 to 90% of chrome carbides and a balance of unavoidable impurities and a nickel-chrome alloy, at least 70% of the carbide particles enclosed by the alloy, and having an average particle size of 5 to 100 μm has been proposed (for example, see Japanese Patent Publication (A) No. 6-116703).

Further, a cermet coating containing at least one of $CrB_2$, $ZrB_2$, WB, $TiB_2$, and other borides in 1 to 60 vol %, containing at least one of $Cr_3C_2$, TaC, WC, ZrC, TiC, NbC, and other carbides in 5 to 50 vol %, and having a balance of substantially metal is provided (for example, see Japanese Patent Publication (A) No. 7-11420).

However, these coatings contain chrome carbides resistant to buildup at a high temperature, but if used for a long time in a continuous annealing furnace, the metal ingredients and chrome carbides in the coatings react resulting in the coatings become brittle and the coatings peeling off.

That is, in the past, various coatings have been proposed, but none of these coatings have been able to completely prevent buildup on hearth roll surfaces.

DISCLOSURE OF THE INVENTION

The problem to be solved by the present invention is the provision of a hearth roll for a continuous annealing furnace enabling suppression of buildup on the hearth roll surface and enabling stable use for a long time under the high temperature environment of a continuous annealing furnace and a method of production of the same.

The inventors engaged in various experimental studies and theoretical studies to solve the problem and as a result discovered that by providing a coating mainly comprised of $Cr_3C_2$ resistant to reaction with iron and manganese oxide on the surface of the hearth roll base material, it is possible to prevent buildup.

However, $Cr_3C_2$ alone cannot form a dense coating. To form a dense coating, combination with a heat resistant alloy is necessary. However, if used for a long time under the high temperature environment in a continuous annealing furnace, the carbon in the $Cr_3C_2$ diffuses in the heat resistant alloy, so the new problem is confronted that the coating becomes brittle and the coating peels off.

Therefore, the inventors engaged in various studies and as a result discovered that by optimizing the composition of the heat resistant alloy to be combined with the $Cr_3C_2$ and the flame spraying method, it is possible to suppress the changes of the coating along with time under the high temperature environment in a continuous annealing furnace. Further, they prepared various prototypes of flame sprayed coatings, studied the prepared prototypes of the flame sprayed coatings for buildup resistance and high temperature characteristics, and thereby completed the present invention. The present invention has as its gist the following:

(1) A hearth roll for a continuous annealing furnace having a cermet coating comprised of a ceramic and a heat resistant alloy on its surface, the hearth roll for a continuous annealing furnace characterized in that the ceramic contains $Cr_3C_2$: over 50 to 90 vol %, $Al_2O_3$: 1 to 40 vol %, $Y_2O_3$: 0 to 3 vol %, and $ZrB_2$: 0 to 40 vol % and has a balance of unavoidable impurities and pores and in that the heat resistant alloy contains Cr: 5 to 20 mass %, Al: 5 to 20 mass %, and one or both of Y and Si: 0.1 to 6 mass % and has a balance of one or both of Co and Ni and unavoidable impurities, 50 to 90 vol % of the cermet coating being the ceramic and the balance being the heat resistant alloy.

(2) A hearth roll for a continuous annealing furnace as set forth in (1) characterized in that the heat resistant alloy contains one or both of Nb: 0.1 to 10 mass % and Ti: 0.1 to 10 mass %.

(3) A hearth roll for a continuous annealing furnace as set forth in (1) or (2) characterized in that the $Cr_3C_2$ has a particle size in the ceramic of 1 to 10 μm.

(4) A method of production of a hearth roll for a continuous annealing furnace as set forth in (1) by flame spraying, the method of production of a hearth roll for a continuous annealing furnace characterized by flame spraying a raw powder on the surface of the hearth roll so as to form a cermet coating on the surface of the hearth roll base material, the raw powder comprising a ceramic powder and heat resistant alloy powder, the ceramic powder containing $Cr_3C_2$: over 50 to 90 vol %, $Al_2O_3$: 1 to 40 vol %, $Y_2O_3$: 0 to 3 vol %, and $ZrB_2$: 0 to 40 vol % and having a balance of unavoidable impurities and pores, the heat resistant alloy powder containing Cr: 5 to 20 mass %, Al: 5 to 20 mass %, and one or both of Y and Si: 0.1 to 6 mass % and has a balance of one or both of Co and Ni and unavoidable impurities, 50 to 90 vol % being the ceramic powder and the balance being the heat resistant alloy powder.

(5) A method of production of a hearth roll for a continuous annealing furnace as set forth in (4) characterized in that the heat resistant alloy powder contains one or both of Nb: 0.1 to 10 mass % and Ti: 0.1 to 10 mass %.

(6) A method of production of a hearth roll for a continuous annealing furnace as set forth in (4) or (5) characterized in that the $Cr_3C_2$ has a particle size in the ceramic of 1 to 10 μm.

(7) A method of production of a hearth roll for a continuous annealing furnace as set forth in any one of (4) to (6) characterized by heating the hearth roll base material to 300 to 600° C. at the time of flame spraying.

(8) A method of production of a hearth roll for a continuous annealing furnace as set forth in any one of (4) to (7) characterized by treating the cermet coating for oxidation at 300 to 600° C. for 1 to 5 hours.

(9) A method of production of a hearth roll for a continuous annealing furnace as set forth in any one of (4) to (8) characterized in that the flame spraying is HVOF spraying and the amount of supply of oxygen gas used as an ingredient of the combustion gas of the HVOF spraying is made 1000 to 1200 liter/min.

(10) A method of production of a hearth roll for a continuous annealing furnace as set forth in any one of (4) to (9) characterized by treating the raw powder for oxidation at 300 to 600° C. for 1 to 5 hours, then supplying it for flame spraying.

(11) A method of production of a hearth roll for a continuous annealing furnace as set forth in any one of (4) to (10) characterized by performing chromate treatment after the flame spraying.

The hearth roll for a continuous annealing furnace according to the present invention suppresses the buildup on the hearth roll surface and enables stable use for a long time under a high temperature environment in a continuous annealing furnace.

Further, according to the method of production of a hearth roll for a continuous annealing furnace according to the present invention, it is possible to produce a hearth roll for a continuous annealing furnace superior in buildup resistance in this way.

That is, according to the hearth roll for a continuous annealing furnace and method of production of the same according to the present invention, it is possible to prevent defects in the steel sheet due to a hearth roll for a continuous annealing furnace and thereby improve the quality of the steel sheet, so the industrial applicability is extremely great.

BRIEF DESCRIPTION OF THE DRAWINGS

FIG. 1 is a view showing a cermet sprayed coating of the present invention.

BEST MODE FOR CARRYING OUT THE INVENTION

The inventors prepared various prototypes of flame sprayed coatings and investigated the state of buildup and high temperature characteristics of the prototype flame sprayed coatings. As a result, they discovered that a cermet coating comprised of a ceramic and heat resistant alloy shown below has a great effect in suppressing buildup and is resistant to deterioration even when used for a long time in a continuous annealing furnace. The present invention was completed based on this technical discovery.

Ceramic:

A ceramic containing $Cr_3C_2$: over 50 to 90 vol %, $Al_2O_3$: 1 to 40 vol %, $Y_2O_3$: 0 to 3 vol %, and $ZrB_2$: 0 to 40 vol % and having a balance of unavoidable impurities and pores. Note that $Y_2O_3$ and $ZrB_2$ are optional ingredients (selective ingredients) added in accordance with need.

Heat Resistant Alloy:

A heat resistant alloy containing

Cr: 5 to 20 mass %,

Al: 5 to 20 mass %, and one or both of Y and Si: 0.1 to 6 mass % and having a balance of one or both of Co and Ni and unavoidable impurities.

Volume Ratio of Ceramic and Heat Resistant Alloy in Cermet Coating:

50 to 90 vol % of the cermet coating is the ceramic and the balance is the heat resistant alloy.

Below, a hearth roll for a continuous annealing furnace according to the present invention will be explained in detail.

In the hearth roll for a continuous annealing furnace according to the present invention having a cermet coating on its surface, 50 to 90 vol % of the cermet coating is made a ceramic and the balance is made CoNiCrAlY, CoCrAlY, NiCrAlY, CoNiCrAlSiY, or another heat resistant alloy.

If the ceramic is less than 50 vol %, the amount of heat resistant alloy easily reacting with the iron becomes too great and therefore buildup easily occurs.

If the ceramic exceeds 90 vol %, the melting point of the ceramic is high, so the coating becomes porous at the time of flame spraying, sources of buildup are caught in the pores, and buildup thereby easily occurs.

Furthermore, from the viewpoint of improvement of the buildup resistance, the ratio of the ceramic is more preferably 60 to 80 vol %.

The main ingredient of the ceramic is $Cr_3C_2$. This is contained in the ceramic in an amount over 50 to 90 vol %. $Cr_3C_2$ is resistant to oxidation in a high temperature environment such as in an annealing furnace and does not easily react with iron and manganese oxide, so can prevent buildup.

If the $Cr_3C_2$ is 50 vol % or less, the buildup suppression effect is not obtained. If the $Cr_3C_2$ exceeds 90 vol %, the ceramic ingredients suppressing diffusion of carbon in the $Cr_3C_2$ become relatively small and as a result carbon diffusion causes the coating to become brittle.

From the viewpoint of suppressing buildup, the $Cr_3C_2$ is more preferably made 55 vol % or more. Furthermore, if 60 vol % or more, a greater buildup suppression effect is obtained.

From the viewpoint of preventing embrittlement of the coating, the $Cr_3C_2$ is more preferably made 85 vol % or less. Furthermore, if made 80 vol % or less, the risk of embrittlement becomes smaller.

The particle size of the $Cr_3C_2$ is preferably 1 to 10 μm. If the particle size of $Cr_3C_2$ is less than 1 μm, the surface area contacting the heat resistant alloy becomes larger, so diffusion of carbon easily occurs.

If the particle size of the $Cr_3C_2$ exceeds 10 μm, the coarseness of the coating surface becomes larger and iron or manganese oxide easily builds up.

From the viewpoint of suppressing diffusion of carbon, the particle size of the $Cr_3C_2$ is more preferably made 3 μm or more. If made 5 μm or more, this is more preferable. Further, from the viewpoint of suppressing the buildup, the particle size of the $Cr_3C_2$ is more preferably made 9 μm or less. If made 8 μm or less, this is more preferable.

$Al_2O_3$ and $Y_2O_3$ both have low coefficients of diffusion of carbon in the material, so diffusion of the carbon of $Cr_3C_2$ into the heat resistant alloy is suppressed.

If $Al_2O_3$ is 1 to 40 vol % and $Y_2O_3$ is 3 vol % or less in the coating, this effect is obtained.

If the $Al_2O_3$ is less than 1 vol %, the effect of suppression of diffusion of carbon is not obtained. If $Al_2O_3$ exceeds 40 vol %, since $Al_2O_3$ easily reacts with manganese oxide, the buildup resistance falls.

Similarly, if $Y_2O_3$ exceeds 3 vol %, since $Y_2O_3$ easily reacts with manganese oxide, the buildup resistance falls.

Note that when adding $Y_2O_3$ for the purpose of obtaining the effect of suppression of diffusion of carbon, it is effective to add 0.5 vol % or more.

Regarding the $Al_2O_3$, from the viewpoint of suppression of diffusion of carbon, 5 vol % or more is more preferable and 10 vol % or more is even more preferable. Further, from the viewpoint of suppressing buildup, 35 vol % or less is more preferable and 30 vol % or less is still more preferable.

$Al_2O_3$ or $Y_2O_3$ can be added as oxides to the raw powder. However, to suppress the diffusion of carbon from the $Cr_3C_2$, it is preferable to perform oxidation treatment at the stage of the raw material, during coating formation, or after coating formation so as to oxidize the Y or Al added to the heat resistant alloy and generate oxides in the form of $Al_2O_3$ or $Y_2O_3$ at the heat resistant alloy surface.

For use at a further higher temperature, to make the high temperature hardness of the flame sprayed coating higher, it is preferable to add $ZrB_2$ stable and high in hardness at a high temperature in an amount of 40 vol % or less. If adding $ZrB_2$ in more than 40 vol %, since the buildup resistance of $ZrB_2$ is inferior to $Cr_3C_2$, buildup easily occurs.

Note that $ZrB_2$ is an optional ingredient (selective ingredient) added for the purpose of use at a high temperature. For this reason, the amount of $ZrB_2$ in the coating should be 40 vol % or less. If the amount of addition of $ZrB_2$ is less than 5 vol %, the effect of raising the high temperature hardness is small, so $ZrB_2$ is more preferably added in an amount of 5 vol % or more. If adding 15 vol % or more, this is more preferable.

However, from the viewpoint of suppressing the buildup, if possible 35 vol % or less is more preferable, while 30 vol % or less is still more preferable.

The balance of the ceramic explained above is unavoidable impurities and pores.

Next, regarding the heat resistant alloy, the heat resistant alloy contains Cr in an amount of 5 to 20 mass %. If the Cr is less than 5 mass %, the oxidation resistance at a high temperature is inferior. For this reason, the coating is continuously oxidized and easily peeled off.

If Cr becomes greater than 20 mass %, when carburized, the heat resistant alloy becomes brittle and easily peels off. Further, when-oxidized, this reacts with the manganese oxide and buildup easily occurs.

The heat resistant alloy also contains 5 to 20 mass % of Al. If Al is less than 5 mass %, even if performing various types of oxidation treatment, the desired amount of $Al_2O_3$ cannot be obtained.

On the other hand, if Al exceeds 20 mass %, the high temperature hardness of the coating falls. For this reason, the iron sticks into the coating and buildup easily occurs.

Y and Si both have the effects of stable production of oxide coatings and prevention of peeling. For this reason, one or both of Y and Si may be added in an amount of 0.1 to 6 mass %. When Y or Si exceeds 6 mass %, the high temperature hardness of the coating falls, so the iron sticks into the coating and buildup easily occurs. Further, Y and Si both have to be added in amounts of 0.1 mass % or more. Adding 0.5 mass % or more is particularly effective.

Further, this heat resistant alloy preferably has added into it one or both of Nb: 0.1 to 10 mass % and Ti: 0.1 to 10 mass %. If Nb or Ti is included in the heat resistant alloy, stable carbides are formed preferentially compared with the Cr contained in the heat resistant alloy and the reaction of Cr and carbon is suppressed. For this reason, it is possible to suppress embrittlement of the coating over a long period. If the Nb or Ti is less than 0.1 mass %, the effect of suppression of the reaction of the Cr and the carbon is not obtained. If over 10 mass %, when oxidized, it easily reacts with the manganese oxide and buildup easily occurs.

The balance of the heat resistant alloy explained above is comprised of one or both of Co and Ni and unavoidable impurities.

Next, the method of production of a hearth roll for a continuous annealing furnace according to the present invention will be explained.

The raw powder is a powder having 50 to 90 vol % of a powder of the ceramic and the balance of a powder of the heat resistant alloy. This raw powder is flame sprayed on the surface of a hearth roll base material so as to form a cermet coating on the surface of the hearth roll base material. As the hearth roll base material, usually stainless steel-based heat resistant cast steel is used. In particular, SCH22 is optimum.

The raw powder comprises a ceramic powder of $Cr_3C_2$, $Al_2O_3$, etc. and a heat resistant alloy powder containing Cr or Al. By mixing and flame spraying these, a coating is formed. Preferably, the ceramic powder and heat resistant alloy powder may be granulated and combined in advance and then flame sprayed so as to form a uniform coating.

When forming a coating on a hearth roll surface, the surface is blasted with grit to impart roughness to improve the adhesiveness with the flame sprayed layer. After this, a high velocity oxygen-fuel thermal spraying process (HVOF) is preferably used to form a coating.

In the HVOF, usually the fuel gas is made kerosene, $C_3H_8$, $C_2H_2$, or $C_3H_6$. The pressure of the fuel gas may be made 0.1 to 1 MPa, the flow rate of the fuel gas 10 to 500 liter/min, the pressure of the oxygen gas 0.1 to 1 MPa, and the flow rate of the oxygen gas 100 to 1200 liter/min.

At the time of flame spraying, it is preferable to heat the hearth roll base material to 300 to 600° C. It is possible to bring the flame of the flame spraying gun close to the hearth roll base material for heating or to provide a separate gas burner for heating. By heating the hearth roll base material to 300° C. or more, it is possible to oxidize the Al and Y in the heat resistant alloy to obtain the desired amounts of $Al_2O_3$ and $Y_2O_3$. If making the heating temperature higher than 600° C., the oxidation of the coating proceeds too much, the coating becomes porous, and buildup easily occurs. Furthermore, from the viewpoint of suppressing the buildup, the range of the heating temperature is more preferably made 400 to 500° C.

At the time of HVOF, the flow rate of the oxygen gas of the HVOF combustion gas ingredient is preferably made 1000 to 1200 liter/min. By making the flow rate of the oxygen gas 1000 liter/min or more, it is possible to oxidize the Al and Y in the heat resistant alloy to obtain the desired amounts of $Al_2O_3$ and $Y_2O_3$. If making the flow rate of the oxygen gas greater than 1200 liter/min, during the flame spraying, the oxidation of the raw powder proceeds too much, the coating becomes porous, and buildup easily occurs.

Further, preferably, after the flame spraying, the coating is treated to oxidize at 300 to 600° C. for 1 to 5 hours. The oxidation treatment may be performed by using a gas burner to heat the flame sprayed coating surface. Alternatively, it is also possible to place the hearth roll in a furnace with an atmosphere of the air or nitrogen or argon or other inert gas containing a small amount of oxygen for heat treatment.

By heating at 300° C. or more for 1 hour or more, it is possible to oxidize the Al and Y in the heat resistant alloy to obtain the desired amounts of $Al_2O_3$ and $Y_2O_3$.

If making the heating temperature higher than 600° C. or the time longer than 5 hours, the oxidation of the coating proceeds too much, the coating becomes porous, and buildup easily occurs. Furthermore, from the viewpoint of improving the buildup resistance, it is more preferable to make the range of heating temperature 400 to 500° C.

When treating the raw powder for oxidation, then using it for flame spraying, it is heat treated at 300 to 600° C. in the air or in an inert gas (nitrogen, argon, etc.) containing a small amount of oxygen for 1 to 5 hours. With heating for less than 300° C. or less than 1 hour, Y or Al is not oxidized. If the heating temperature is higher than 600° C. or longer than 5 hours, the amount of ceramic oxide increases, so the melting point of the raw powder becomes higher and the coating becomes porous.

Furthermore, from the viewpoint of suppressing the buildup, the heat treatment temperature is more preferably made a range of 400 to 500° C.

Above, according to the method of the present invention, compared with the conventional method of production, by optimally controlling the advance heat treatment temperature of the raw powder, optimizing the flame spraying conditions, and optimizing the roll heating conditions after flame spraying, it is possible to oxidize the Al and Y in the heat resistant alloy in the flame sprayed coatings to obtain the desired amounts of $Al_2O_3$ and $Y_2O_3$ and realize the coating of the present invention.

Further, by chromate treatment of the coating after flame spraying, even when the flame sprayed coating has fine pores, the pores can be filled with chrome oxide and oxidation treatment can be performed simultaneously. However, the chromate treatment coating easily reacts with manganese oxide, so has to be made a thin film of 10 μm or less.

The chromate treatment is performed by dipping part of the hearth roll in an aqueous solution containing chromic acid or coating or spraying an aqueous solution containing chromic acid on the surface of the hearth roll, then heating at 350 to 550° C. for forming a coating. By repeating this, it is possible to change the thickness of the coating in the chromate treatment. The thickness becomes greater each time the number of treatments is increased, so it is preferable to end this within three or so treatments.

Examples

The examples shown in Table 1 will be used to more specifically explain the present invention.

As each hearth roll base material, stainless steel-based heat resistant cast steel (JIS SCH22) was used.

First, to obtain adhesiveness with each coating, the surface of the roll 1 shown in FIG. 1 was blasted with alumina grit. Next, HVOF was used to form the coating.

In each of Invention Example Nos. 4, 5, 6, and 14 with a large ceramic content in the cermet sprayed coating 3, a priming layer 2 comprised of only a heat resistant alloy was provided on the roll surface to prevent peeling due to the difference in coefficients of heat expansion of the hearth roll base material and the cermet coating.

The cermet sprayed coatings 3 had thicknesses of 50 to 300 μm and the compositions shown in Table 1.

In the HVOF, the fuel gas was made kerosene, the pressure of the fuel gas was made 0.5 MPa, the flow rate of the fuel gas was made 300 liter/min, the pressure of the oxygen gas was made 0.5 MPa, and the flow rate of the oxygen gas was made 700 to 1200 liter/min.

In each of Invention Example Nos. 1 and 2, a raw powder treated in advance for oxidation was used for flame spraying.

In each of Invention Example Nos. 3, 4, and 5, the flame spraying was performed at a flow rate of the oxygen gas of 1000 to 1200 liter/min.

In each of Invention Example Nos. 6 and 7, the flame of the flame spraying gun was brought close to the hearth roll base material for heating it to 300° C. and 600° C. for flame spraying.

In each of Invention Example Nos. 8 and 9, after flame spraying, a gas burner was used to heat the flame sprayed coating surface at 600° C. for 1 hour and at 300° C. for 5 hours.

In each of Invention Example Nos. 13 and 14, after flame spraying, chromate treatment was performed. The chromate treatment was performed by coating an aqueous solution containing chromic acid on the hearth roll surface, then heating at 500° C. and repeating this three times.

The hearth rolls of the invention examples and the comparative examples were used in a soaking zone of a continuous annealing furnace (rolls: ϕ1 m, atmosphere: temperature 850° C., nitrogen-hydrogen: 3%, dew point: −30° C., steel sheet: tensile strength 10 MPa, steel sheet average thickness: 1 mm, speed 300 mpm, steel type: high strength steel) for one year. Their evaluations are summarized in Table 1.

Invention Example Nos. 1 to 14 had no peeling of the flame sprayed coatings and no buildup even after being used for 1 year. In particular, Invention Example Nos. 4 to 9 having heat resistant alloys containing Ti or Nb and having optimized particle sizes of $Cr_3C_2$ had no peeling of the flame sprayed coatings and no buildup even after being used for 2 years.

On the other hand, in Comparative Example Nos. 1 and 2 differing in ingredients of flame sprayed coatings and production methods compared with the invention examples, the coatings peeled off after half a year, while in Comparative Example Nos. 3 to 4, buildup occurred after half a year.

Therefore, as shown in Table 1, it was learned that the coatings of the invention examples did not peel off even with long use and, further, the effect of suppression of buildup was extremely superior. From this, the effect of the present invention was confirmed.

TABLE 1

| | | Raw powder oxidation treatment | | Amount of supply of | Base material | Flame sprayed coating composition Ceramic | |
|---|---|---|---|---|---|---|---|
| | | Temp. (° C.) | Time (hr) | oxygen during flame spraying (liter/min) | temp. (° C.) | Volume ratio of ingredients in ceramic | Volume ratio of ceramic in coating |
| Inv. ex. | 1 | 300 | 5 | 800 | 200 | $60Cr_3C_2$—$40Al_2O_3$ | 50 |
| | 2 | 600 | 1 | 900 | 100 | $90Cr_3C_2$—$10Al_2O_3$ | 60 |
| | 3 | 400 | 3 | 1000 | 200 | $80Cr_3C_2$—$20Al_2O_3$ | 70 |
| | 4 | 500 | 2 | 1100 | 300 | $70Cr_3C_2$—$30Al_2O_3$ | 80 |
| | 5 | No | | 1200 | 400 | $90Cr_3C_2$—$10Al_2O_3$ | 90 |
| | 6 | No | | 900 | 300 | $80Cr_3C_2$—$20Al_2O_3$ | 80 |
| | 7 | No | | 700 | 600 | $59Cr_3C_2$—$40Al_2O_3$—$1Y_2O_3$ | 70 |
| | 8 | No | | 900 | 200 | $78Cr_3C_2$—$20Al_2O_3$—$2Y_2O_3$ | 60 |
| | 9 | No | | 900 | 200 | $76Cr_3C_2$—$20ZrB_2$—$1Al_2O_3$—$3Y_2O_3$ | 50 |
| | 10 | No | | 900 | 200 | $76Cr_3C_2$—$10ZrB_2$—$11Al_2O_3$—$3Y_2O_3$ | 50 |
| | 11 | No | | 900 | 200 | $66Cr_3C_2$—$30ZrB_2$—$1Al_2O_3$—$3Y_2O_3$ | 50 |
| | 12 | No | | 900 | 200 | $81Cr_3C_2$—$5ZrB_2$—$11Al_2O_3$—$3Y_2O_3$ | 50 |
| | 13 | No | | 900 | 200 | $51Cr_3C_2$—$40ZrB_2$—$10Al_2O_3$ | 60 |
| | 14 | No | | 900 | 200 | $79.5Cr_3C_2$—$20Al_2O_3$—$0.5Y_2O_3$ | 80 |
| C. ex. | 1 | No | | 900 | 200 | $100Cr_3C_2$ | 60 |
| | 2 | No | | 900 | 200 | $100Cr_3C_2$ | 75 |
| | 3 | No | | 800 | 200 | $5ZrB_2$—$85Cr_3C_2$—$10Al_2O_3$ | 40 |
| | 4 | No | | 800 | 200 | $100Al_2O_3$ | 30 |

| | | Flame sprayed coating composition Mass % of ingredients in heat resistant alloy | $Cr_3C_2$ average particle size (μm) | Heat treatment after flame spraying | Evaluation Build-up | Peeling | Overall |
|---|---|---|---|---|---|---|---|
| Inv. ex. | 1 | Bal. Co—5Cr—5Al—1Y | 25 | No | No | No | Good |
| | 2 | Bal. Co—20Cr—20Al—2Y | 15 | No | No | No | Good |
| | 3 | Bal. Co—20Cr—20Al—3Y | 12 | No | No | No | Good |
| | 4 | Bal. Co—10Cr—10Al—0.1Nb—0.5Y | 10 | No | No | No | Very good |
| | 5 | Bal. Co—10Cr—10Al—2Y—0.1Ti | 1 | No | No | No | Very good |
| | 6 | Bal. Co—10Cr—10Al—3Y—5Nb | 5 | No | No | No | Very good |
| | 7 | Bal. Co—15Cr—15Al—1Y—5Ti | 8 | No | No | No | Very good |
| | 8 | Bal. Co—20Cr—20Al—3Si—10Ti | 10 | 600° C. × 1 hr | No | No | Very good |
| | 9 | Bal. Co—10Cr—10Al—1Y—1Si—10Nb | 7 | 300° C. × 5 hr | No | No | Very good |
| | 10 | Bal. Co—10Cr—10Al—2Si | 15 | 400° C. × 3 hr | No | No | Good |
| | 11 | Bal. Co—10Cr—10Al—0.5Si | 12 | 500° C. × 2 hr | No | No | Good |
| | 12 | Bal. Ni—20Co—10Cr—10Al—2Y—2Si | 13 | 550° C. × 2 hr | No | No | Good |
| | 13 | Bal. Ni—15Cr—15Al—3Y—3Si | 11 | Chromate treatment | No | No | Good |
| | 14 | Bal. Ni—20Cr—10Al—1Y | 15 | Chromate treatment | No | No | Good |
| C. ex. | 1 | Bal. Co—20Cr—20Al | 10 | No | — | Yes | Poor |
| | 2 | Bal. Co—20Cr—20Al—3Y | 10 | No | — | Yes | Poor |
| | 3 | Bal. Co—20Cr—20Al—2Y | 15 | No | Yes | No | Poor |
| | 4 | Bal. Co—5Cr—5Al—1Y | — | No | Yes | No | Poor |

The invention claimed is:

1. A hearth roll for a continuous annealing furnace, the hearth roll having a cermet coating comprising 60 to 80 vol % of a ceramic and a balance of a heat resistant alloy on a surface of the hearth roll, wherein the ceramic comprises:

$Cr_3C_2$: over 55 to 90 vol %, $Al_2O_3$: 1 to 40 vol %, $Y_2O_3$: 0.5 to 3 vol %, $ZrB_2$: 0 to 40 vol %, and a balance of unavoidable impurities and pores, and the heat resistant alloy comprises:

Cr: 5 to 20 mass %,

Al: 5 to 20 mass %, one or both of Y and Si: 0.1 to 6 mass %, and a balance of one or both of Co and Ni and unavoidable impurities.

2. The hearth roll for a continuous annealing furnace as set forth in claim 1, wherein the heat resistant alloy further comprises one or both of Nb: 0.1 to 10 mass % and Ti: 0.1 to 10 mass %.

3. The hearth roll for a continuous annealing furnace as set forth in claim 1, wherein the $Cr_3C_2$ in the ceramic has a particle size of 1 to 10 μm.

* * * * *